United States Patent [19]

Yamamoto

[11] Patent Number: 4,581,798

[45] Date of Patent: Apr. 15, 1986

[54] RICE-CLEANING ROLLER OF A GRINDING TYPE

[76] Inventor: Soichi Yamamoto, 813-17 Oaza Tendou Kou, Tendou-Shi, Yamagata-Ken, Japan

[21] Appl. No.: 598,921

[22] Filed: Apr. 10, 1984

[30] Foreign Application Priority Data

Aug. 13, 1983 [JP] Japan ..... 58-148615
Nov. 29, 1983 [JP] Japan ..... 58-225041

[51] Int. Cl.[4] ..... B21B 31/08

[52] U.S. Cl. ..... 29/124; 29/121.4; 241/294

[58] Field of Search ..... 29/121.4, 124; 241/294

[56] References Cited

U.S. PATENT DOCUMENTS 667,304 2/1901 Feix ..... 29/124

2,770,082 11/1956 Whitesell ..... 29/124

*Primary Examiner*—Mark Rosenbaum
*Assistant Examiner*—Timothy V. Eley
*Attorney, Agent, or Firm*—Browdy and Neimark

[57] ABSTRACT

Prior art grinding type rice-cleaning rollers made of emery have been sintered members having a frustum of cone shape or an abacus bead shape. Their manufacture, therefore, is considerably troublesome, and they can be manufactured in only the special factories. In addition, once they are partly broken, they must be discarded. According to the present invention a plurality of rectangular elongate grinding type roller elements made of emery are arranged side by side on the outer periphery of a rotary member by the suitable means. Thus, it can be easily manufactured, so that its cost is very low. In addition, if it is partly broken, only the broken roller element may be replaced.

7 Claims, 12 Drawing Figures

RICE-CLEANING ROLLER OF A GRINDING TYPE

DETAILED DESCRIPTION OF THE INVENTION

This invention relates to a rice-cleaning roller of a grinding type.

Prior art grinding type rice-cleaning rollers made of emery include one having a hollow frustum of a cone shape A as shown in FIG. 1 and one with an upper half having the shape of an abacus bead and a lower half having a cylindrical shape as shown in FIG. 2. In either case, the structure is hollow and pipe-like in shape.

The grinding type rice-cleaning roller made of emery is considerably troublesome to manufacture. Actually, it can be produced only in a factory having the special equipment, it cannot be easily manufactured in a factory without any special equipment.

In addition, even when it is partly broken, it must be discarded although the other portion than the broken portion is perfect because the broken portion cannot be repaired.

Further, since it is manufactured in a very troublesome way as noted above, its price is strikingly high.

Still further, in a vertical grinding type rice-cleaning machine using the conventional grinding type rice-cleaning rollers made of emery, rice grains flow down a rice-cleaning chamber by their own weight, so that the time of hulling rice is short, which is undesired from the standpoint of the efficiency of the rice-cleaning operation.

The present invention has an object of overcoming the drawbacks noted above in the prior art by the provision of the grinding type rice-cleaning rollers which, unlike the prior art rice-cleaning rollers of this kind, comprise a plurality of rectangular grinding roller elements arranged side by side in the circumferential direction of the roller.

Also, according to the present invention a grinding roller which is very inexpensive compared to the prior art roller of this type can be obtained.

Further, according to the present invention the rice-cleaning roller can be manufactured by a far simpler method than the method of manufacture of the conventional rice-cleaning roller.

Still further, according to the present invention there is provided a rice-cleaning roller which, unlike the prior art, comprises pluralities of rectangular grinding roller elements and friction roller elements alternately arranged side by side in the circumferential direction, so that permits a rice-cleaning operation of a large stroke and also permits hulling rice by grinding and cleaning by friction to be effected simultaneously.

In the drawings

Figure 1:
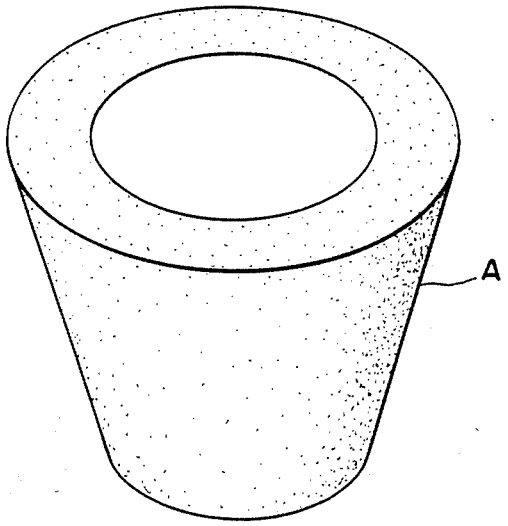
FIG. 1 PRIOR ART
FIG. 1 is a perspective view showing a first prior art rice-cleaning roller.

A first embodiment of the present invention will now be described with reference to FIGS. 3 through 7. Referring to the Figures, reference numeral 1 designates a vertical screw feeder. It comprises a metal cylindrical section 2 with integral peripheral spiral ridges 3,3. It is formed as a metal casting separate from a mounting section 4 which will be described later in detail. The screw feeder 1 and mounting section 4 are coupled to each other in a coupling section by means of a pin or the like.

The mounting section 4 is hollow and has a cylindrical inner surface 5. On its outer side, it has a plurality of mounting surfaces 6. In this embodiment, the mounting surfaces 6 are formed on the front, back and opposite sides of the section 6 respectively, and the section 6 thus has a shape of a square rod. The mounting section 4 has rectangular grooves 8 each formed along each corner section 7 between adjacent mounting surfaces 6.

Each of the rectangular grooves 8 has slit-like shape extending vertically over the entire corner section 7 of the mounting section 4, and it can receive a roller element retainer 9. The roller element retainer 9 has a shape capable of being snugly fitted in the rectangular groove 8. When it is fitted in the rectangular groove 8, a slight gap is defined between its inner surface 10 and the groove bottom surface 11 of the rectangular groove 8.

When the roller element retainer 9 is fitted in the rectangular groove 8, its outer surface 12 is found above the top of the rectangular groove 8. Its portion with the outer surface 12 projecting from the rectangular groove 8 has outwardly extending tapered opposite retainer edges 13.

Threaded holes 14, 14 are formed in the groove bottom surfaces 11 of each rectangular groove 8 adjacent to the upper and lower ends thereof. Each roller element retainer 9 has see-through holes 15, 15 formed in positions corresponding to the threaded holes 14 adjacent its upper and lower ends. Set screws 16 are passed through the see-through holes 15 and screwed into the threaded holes 14, whereby the roller element retainer 9 is secured in position in the rectangular groove 8. The gap defined between the inner surface 10 of the roller element retainer 9 and the groove bottom surface 11 of the rectangular groove 8 serves to permit reliable clamping of the set screws 16.

A communication opening 18 is formed in the groove bottom surface 11 of the rectangular groove 8 at a position thereof intermediate between the threaded holes 14, 14, and communicates with the interior 17 of the mounting section 4. It is formed rather in a lower portion of the groove bottom surface.

The roller element retainer 9 has a blowing opening 19 formed in a portion corresponding to the communication opening 18. A rotary sleeve member 20 is fitted in the mounting section 4. An inner portion of each threaded hole 14 is defined by a cylindrical inner projection 21. The bottom or inner end surface 22 of the cylindrical inner projection 21 closely fits on the outer periphery 23 of the rotary sleeve member 20. However, there may be formed a slight gap between the inner end surface 22 and outer periphery 23.

The rotary sleeve member 20 has a plurality of see-through holes 24. Its interior consistutes an air path 25 communicating with a blower. Air supplied from the blower into the air path 25 flows through the see-through through holes 24 into the space between the rotary sleeve member 20 and mounting section 4 and thence is blown out through the communication opening 18 and blowing opening 19.

The roller element retainers 9 are each fitted in each of the rectangular grooves 8, and each rectangular grinding type roller element 26 made of emery is held clamped between the opposite side roller element retainer edges 13.

The grinding type roller element 26 made of emery has its opposite sides 27 flaring toward the inner surface (or bottom surface) so that it can be securely clamped between the opposite side roller element retainer edges 13. The inner surface (or bottom surface) 28 of the grinding type roller 26 made of emery is adapted to be in close contact with the mounting surface 6. In assembly, each grinding type roller element 26 made of emery is applied to each mounting surface 6, and then the roller element retainers 9 are fitted and secured by the set screws 16 so that the individual roller elements 26 are retained.

A second embodiment will now be described with reference to FIGS. 8 through 12.

Figure 9:
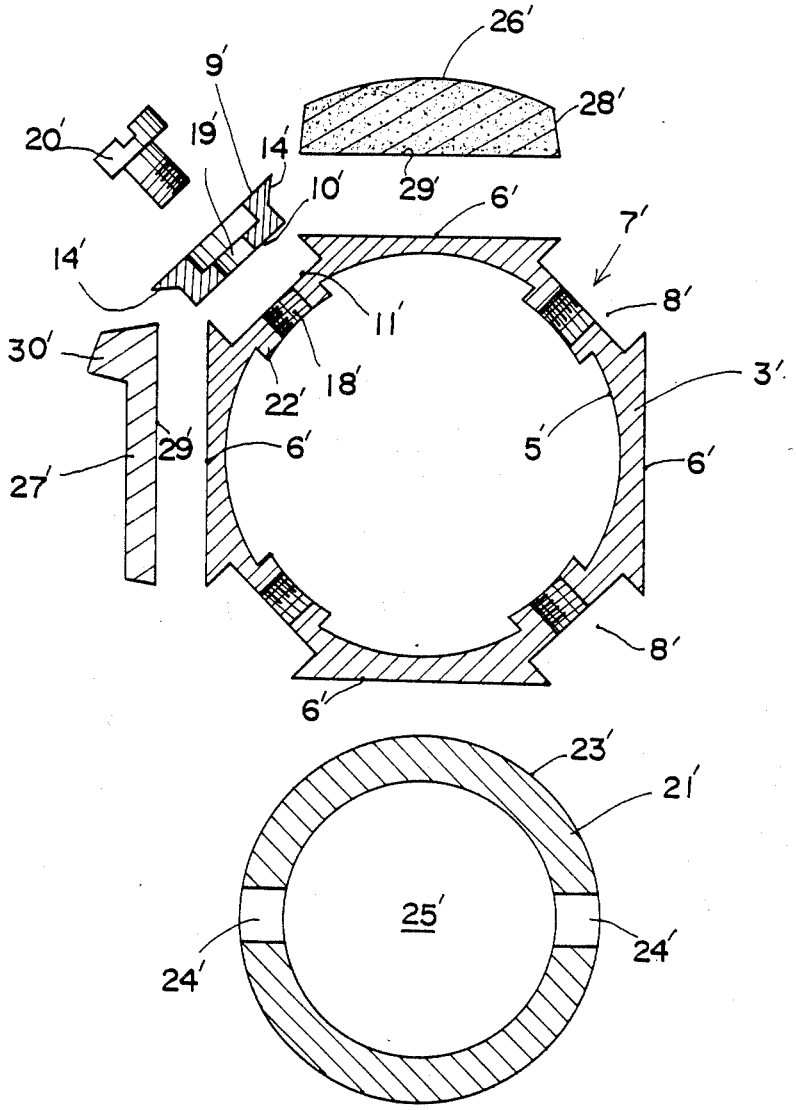
FIG. 9 is an exploded sectional view taken along line IX—IX showing a second embodiment.
Figure 10:
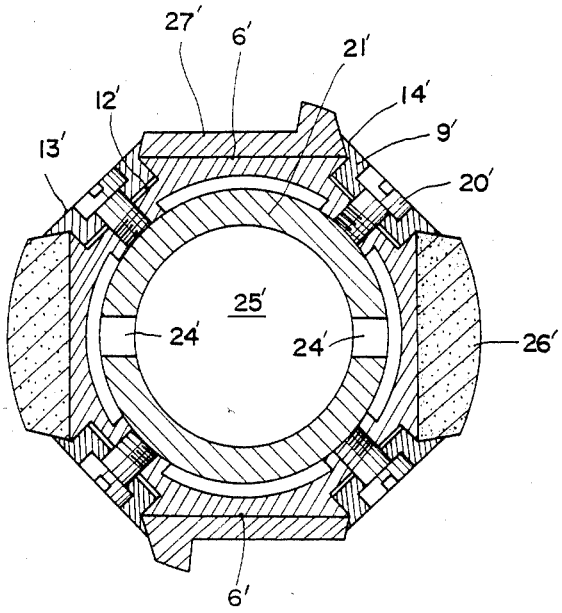
FIG. 10 is a sectional view taken along line IX—IX showing a second embodiment.
Figure 11:
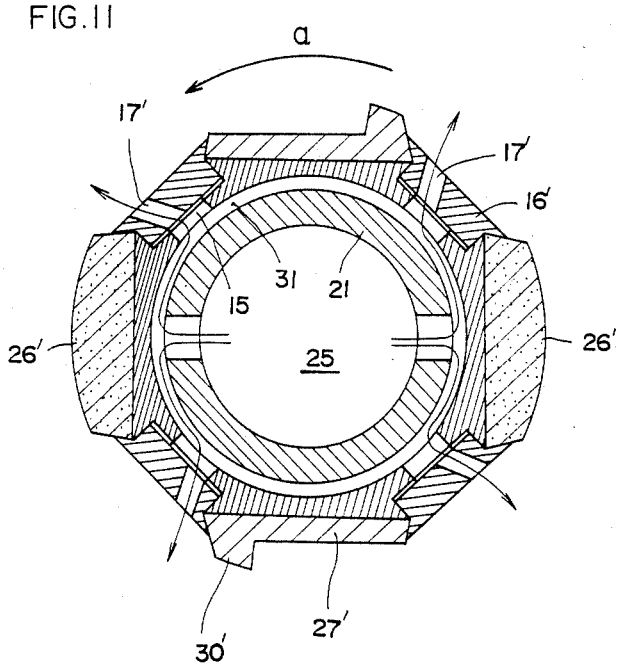
FIG. 11 is a sectional view taken along line XI—XI showing a second embodiment.
Figure 12:
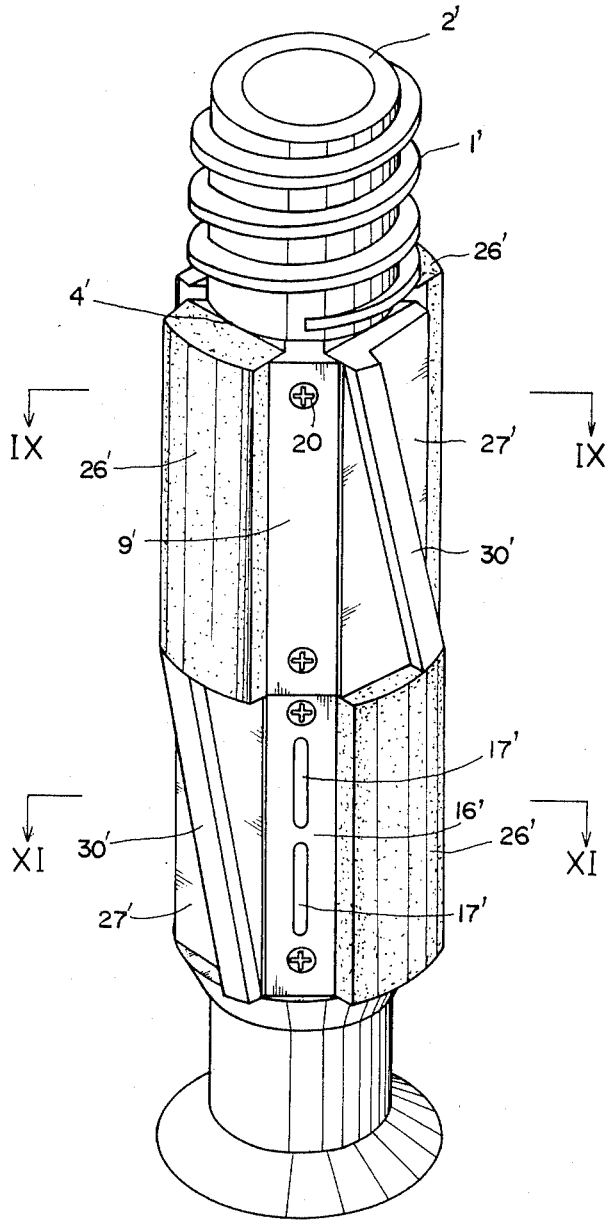
FIG. 12 is a perspective view showing a second embodiment.

Referring to the Figures, reference numeral 1' designates a vertical screw feeder. It comprises a vertical metal cylinder 2' with an integral peripheral spiral ridge. It is formed as a metal separate from a mounting cylinder 3' which will be described later in detail. The screw feeder 1' and mounting cylinder 3' are coupled to each other in a coupling section 4' by means of a pin or the like. The mounting cylinder 3' is hollow and has a cylindrical inner surface 5' as shown in FIG. 9. On its outer side, it has a plurality of mounting surfaces 6'. In this embodiment, the mounting surfaces 6' are formed on the front, back and opposite sides, of the section 6' respectively, and the section 6' thus has a shape of a square cylinder. The mounting cylinder 3' has rectangular grooves 8' in upward and downward directions each formed along each corner section 7' between adjacent mounting surfaces 6'. Each of the rectangular grooves 8' extends over the entire length of the mounting cylinder 3' from the upper end to the lower end, and it can receive a roller element retainer 9'. The roller element retainer 9' has an inner portion which snugly fits in the rectangular groove 8'. When it is fitted in the rectangular groove 8', a slight gap 12' is defined between its inner surface 10' and the bottom surface 11' of the rectangular groove 8'. When the inner portion of the roller element retainer 9' is fitted in the rectangular groove 8', its outer surface 13' is found above the top of the rectangular groove 8'. Its portion with the outer surface 13' has outwardly extending tapered opposite edges 14'. The bottom surface 11' of the rectangular groove 8' has no blowing opening formed in its upper portion. In its lower portion, however, it has a blowing opening 15'. Each roller element retainer 9' engages only the upper portion of the rectangular groove 8', while each lower roller element retainer 16' engages the lower portion of the rectangular groove 8'. The lower roller element retainer 16' has air flow openings 17', 17'. Threaded holes 18' are formed in the bottom surface 11' of the mounting cylinder 3'. The roller element retainers 9' and 16' have see-through holes 19' formed in positions corresponding to the threaded holes 18'. They are secured by inserting set screws 20' through the see-through holes 19'. The gap 12' between the inner surface 10' of the roller element retainer 9' and the bottom surface 11' of the rectangular groove 8' serves to permit reliable clamping of the roller element retainers 9' and 16' with the set screws 20'. The air flow openings 17' formed in the lower roller element retainer 16' are directed such that air is blown out in the direction a of rotation of the roller. A rotary sleeve member 21' is fitted in the mounting cylinder 3'. An inner portion of each threaded hole 18' is defined by a cylindrical inner projection 22'. The bottom or inner end surface of the cylindrical inner projection 22' closely fits on the outer periphery 23' of the rotary sleeve member 21'. However, there may be formed a slight gap between the inner end surface of the cylindrical inner projection 22' and outer periphery 23'. The rotary sleeve member 21' has a plurality of see-through holes 24'. Its interior consistutes an air path 25' communicating with a blower. Air supplied from the blower into the air path 25' flows through the see-through holes 24' into the space 31' defined between the rotary sleeve member 21' and mounting cylinder 3' and thence blown out through the blowing openings 15' and air flow opening 17'. The roller element retainer 9' and 16' are each fitted in each of the rectangular grooves 8',8', and a rectangular grinding type roller element 26' and friction type roller element 27' are held clamped between the opposite side roller element retainer edges 14'. The friction type roller element 27' may be formed as a metal casting. Alternately, it may be formed by forging for it is rectangular in shape, thus it can be easily manufactured. The grinding type roller element 26' and friction type roller element 27' each have the tapered opposite sides 28' flaring toward the inner surface (or bottom surface 29') so that it can be securely clamped between the opposite side roller element retainer edges 14'. Each friction type roller element 27' has a ridge 30. In this embodiment, a plurality of friction type roller elements 27' with ridges 30' of different heights are prepared. The grinding type roller elements 26' and friction type roller elements 27' are alternately mounted in side by side arrangement in the circumferential direction. The ridge 30' is inclined with respect to the direction a of rotation such as to force rice grains to come up to upwardly.

The operation will now be described.

The assembly of the embodiment of FIGS. 3 through 6 will first be described. The mounting section 4 is first fitted on the rotary sleeve member 20, and then the screw feeder 1 is fitted on the top of the mounting section 4. The screw feeder 1 and mounting section 4 are then coupled together in the coupling section by clutch coupling. Then, the inner surfaces 28 of the grinding type roller elements 26 made of emery are applied to the mounting surfaces 6 on the front, back and opposite sides of the mounting section 4, and the roller element retainers 9 are applied to the corner section 7 and fitted in the rectangular grooves 8. The opposite sides 27 of each grinding type element 26 made of emery are thus engaged by the corresponding edges 13 of the opposite side roller element retainers 9. In this state, the see-through holes 15 are aligned to the threaded holes 14, and the set screws 16 are inserted through the see-through holes 15 and clamped, whereby the grinding type roller elements 26 made of emery are simply mounted on the outer periphery of the mounting section 4 to obtain the grinding type rice-cleaning roller.

When one of the grinding type roller elements 26 made of emery is broken during rice-cleaning operation, only that element may be replaced by loosening the associated set screws 16 without need of replacing the other grinding type roller elements 26 made of emery.

In the rice-cleaning operation, air supplied from the blower flows through the air path 25, see-through holes 24, the space between the outer periphery 23 and cylindrical section 5, communication opening 18 and blowing opening 19.

Now, the assembly of the embodiment of FIGS. 7 through 12 will be described. Among the pluralities of the grinding type roller elements 26' and friction type roller elements 27', desired ones are selected. The selected roller elements 26' and 27' are alternately applied to the mounting surfaces 6,6 of the mounting section 4 in the circumferential direction. Then, the roller element retainers 9' are applied to the corner section 7' and fitted in the rectangular grooves 8'. The set screws 20' are then inserted through the see-through holes 19' and screwed in the threaded holes 18', whereby the grinding type roller elements 26' and friction type roller elements 27' are secured by the edges 14' of the roller element retainers 9'.

Figure 2:
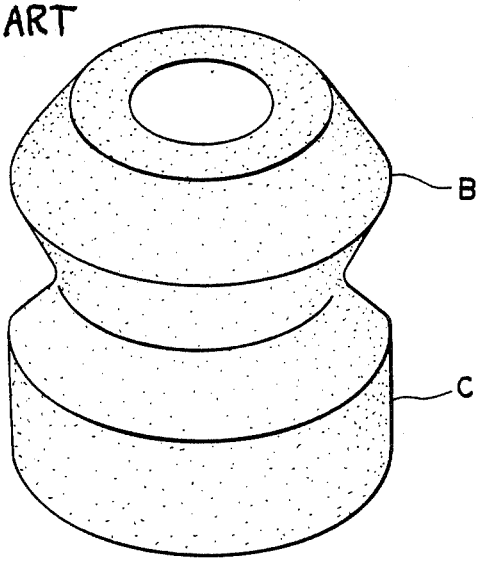
FIG. 2 PRIOR ART
FIG. 2 is a perspective view showing a second prior art rice-cleaning roller.
Figure 3:
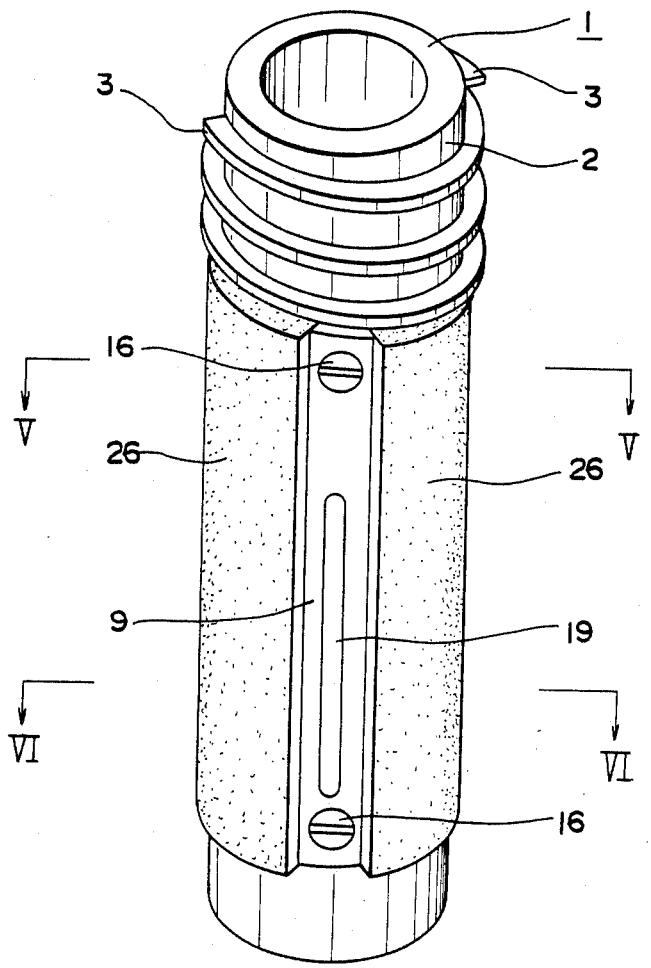
FIG. 3 is a perspective view showing a first embodiment of the present invention.
Figure 4:
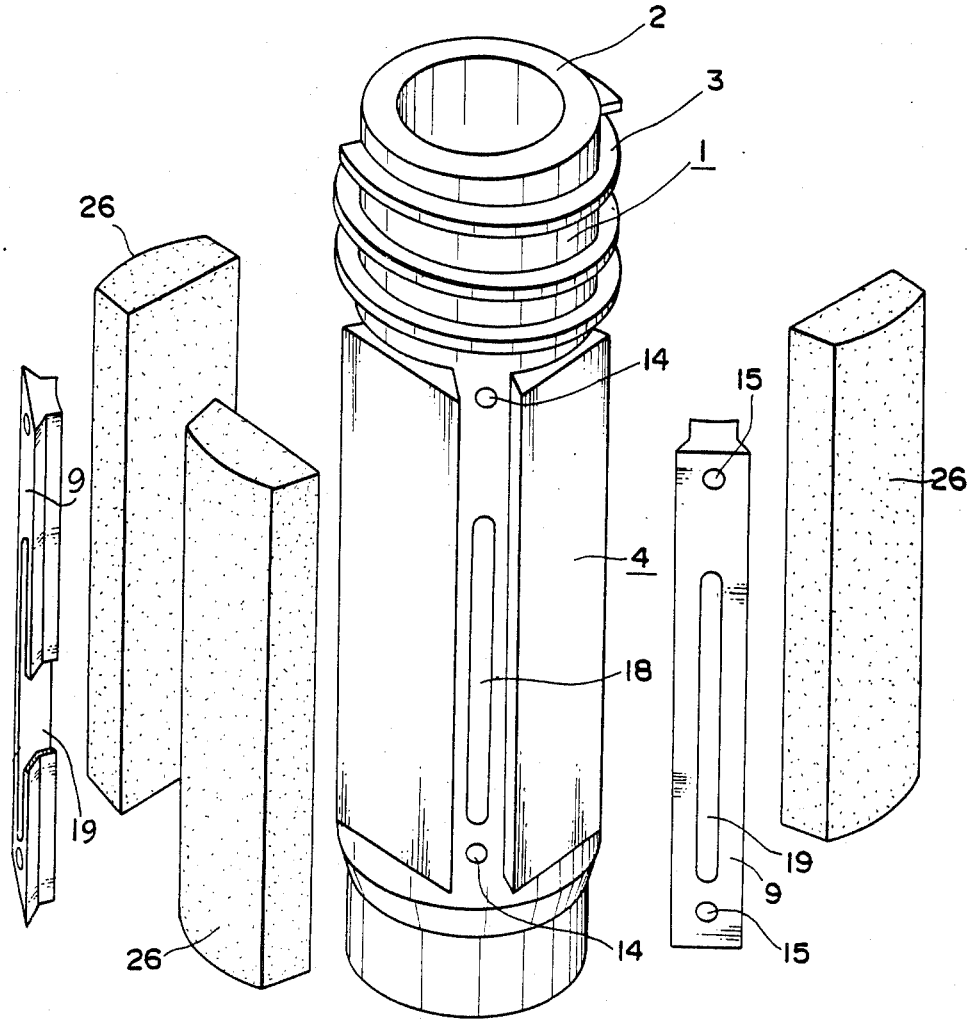
FIG. 4 is an exploded perspective view showing a first embodiment.
Figure 5:
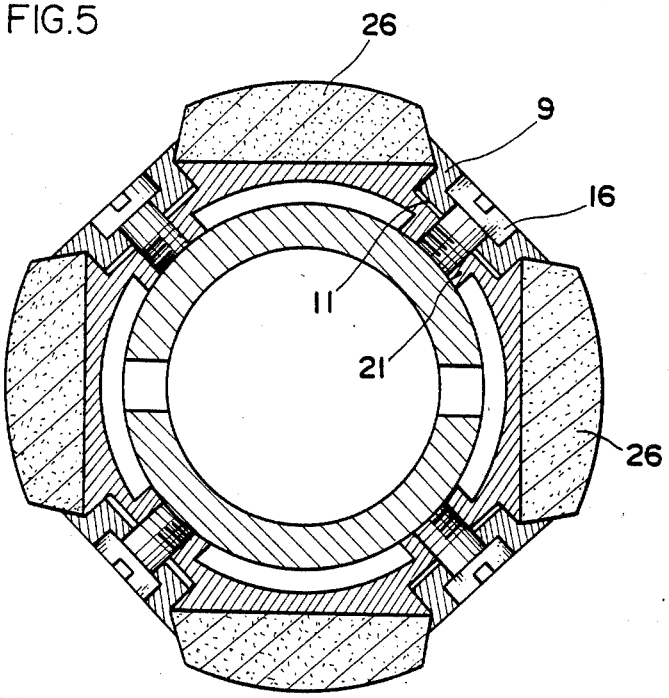
FIG. 5 is a sectional view taken along line V—V showing a first embodiment.
Figure 6:
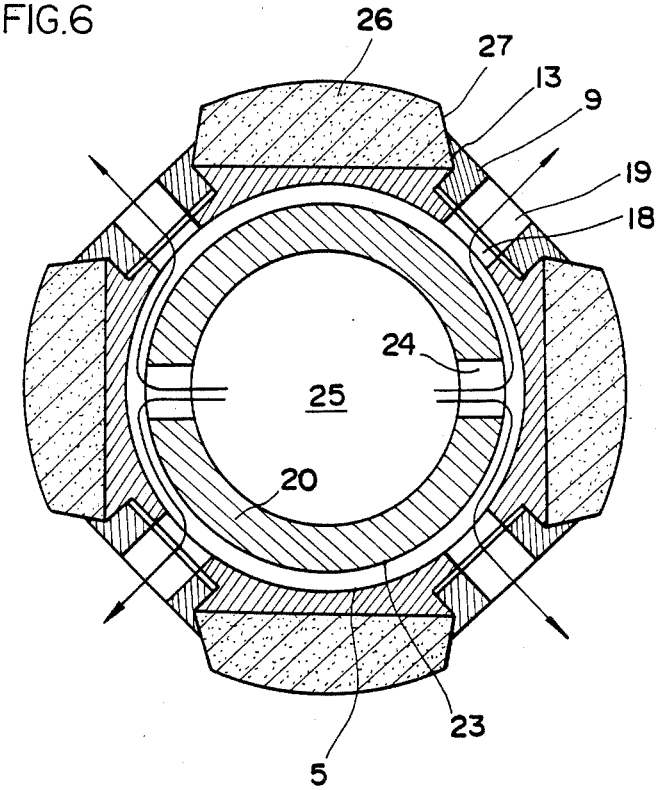
FIG. 6 is a sectional view taken along line VI—VI showing a first embodiment.
Figure 7:
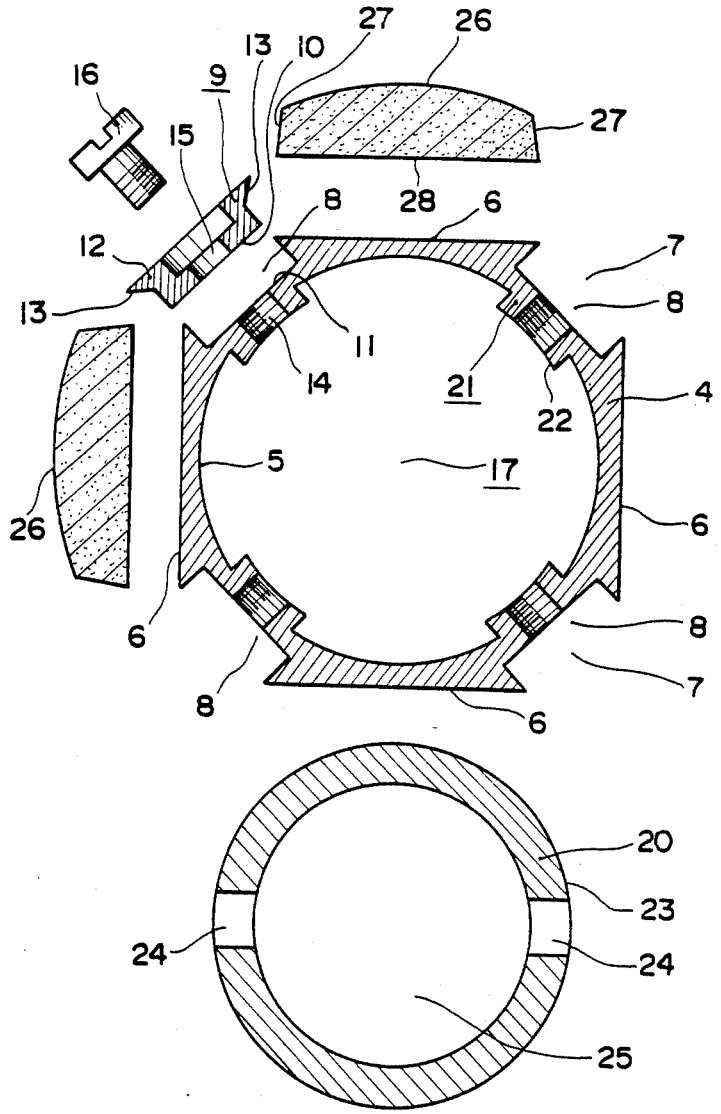
FIG. 7 is an exploded sectional view corresponding to FIG. 5.
Figure 8:
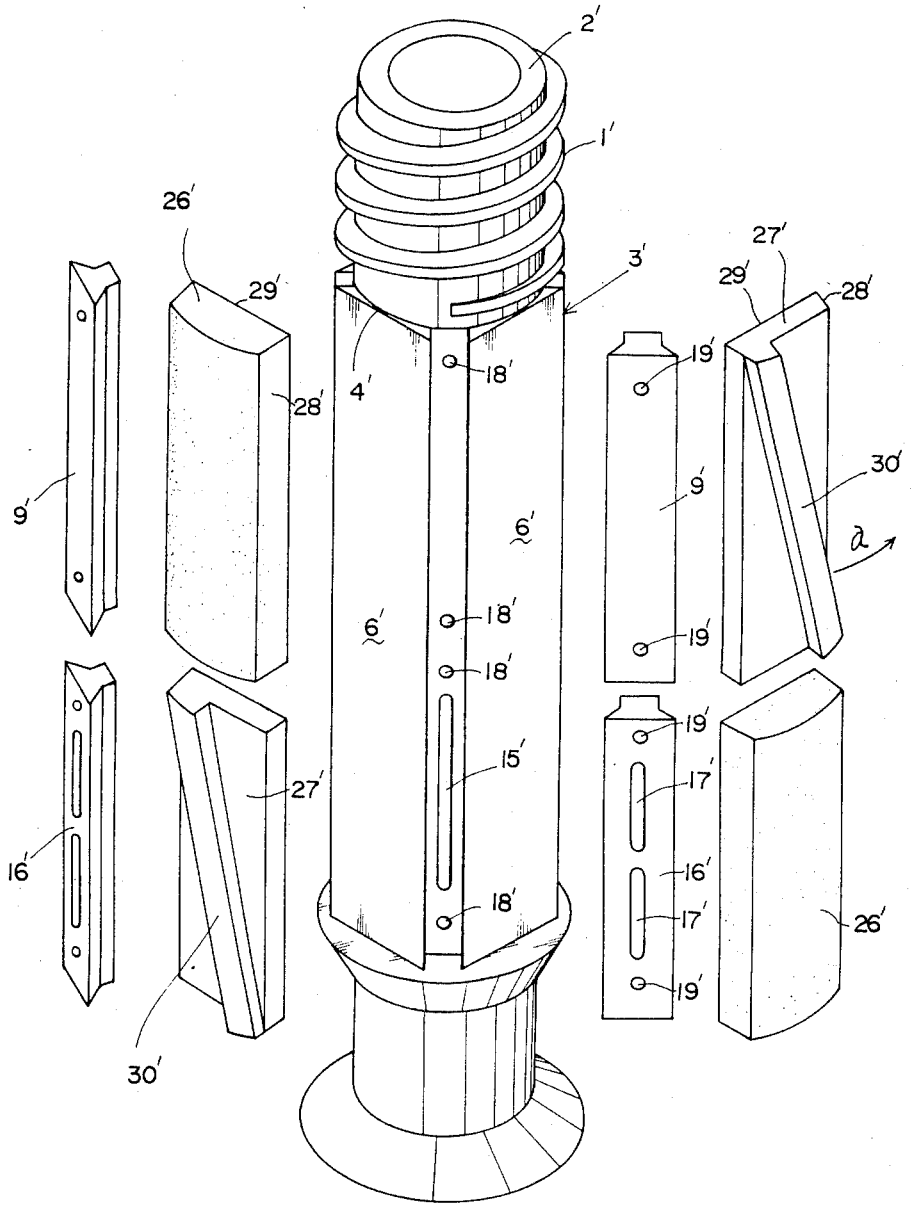
FIG. 8 is an exploded perspective view showing a second embodiment.

Since the bottom or inner surface 29' of each of the grinding type roller elements 26' and friction type roller elements 27' is flat, it is rendered into close contact with the corresponding mounting surface 6. Also, the opposite sides 28' of each of the grinding type roller elements 26' and friction type roller elements 27' flare toward the bottom, each roller element can be securely urged and retained by the edges 14' of the roller element retainers 9'. In the above way, the roller elements 26' and 27' can be installed very simply. In the same way, the grinding type roller elements 26' and friction type roller elements 27' are alternately applied to the lower mounting surfaces 6 in the circumferential direction and secured by the roller element retainers 16', whereby a rice-cleaning roller as shown in FIG. 2 can be obtained.

When the rice-cleaning roller of this construction is used for rice-cleaning, rice grains are hulled while they are agitated in the horizontal direction by the grinding type roller elements 26' and friction type roller elements 27'. As soon as the individual rice grains are roughened its surfaces, which are smooth state by the grinding type roller elements 26', they are then frictioned and smoothened by the friction type roller elements 27'. In this way, the grinding and frictional smoothing are carried out simultaneously so that very ideal rice-cleaning can be obtained.

Further, in the rice-cleaning chamber rice grains having been ground by the grinding type roller elements 26' are raised by the ridges 30' of the friction type roller elements 27' to be ground once again by the grinding type roller elements 26'. Thus, the rice grains fall down the rice-cleaning chamber at a sufficiently slow speed to obtain satisfactory rice hulling.

When the rice grains reach the lower portion of the rice-cleaning chamber, it is subjected to rice hulling action once again like as in the upper portion, while air is blown out through the blowing opening 15' and air flow opening 17' to completely remove the rice bran particles to obtain cleaned rice.

The prior art grinding type rice-cleaning roller made of emery has been manufactured in a considerably troublesome way, so that it could have been manufactured only in a factory with the special equipment; that is, it could not have been easily manufactured in a factory without any special equipment. In addition, when it is partly broken, it must be discarded although its portion other than the broken portion is perfect because the broken portion cannot be repaired. Further, since it is manufactured in the very troublesome way, its price is strikingly high.

In contrast, according to the present invention a plurality of rectangular grinding type roller elements are arranged side by side in the circumferential direction, so that it is possible to obtain a rice-cleaning roller which is very low in price compared to the prior art rice-cleaning roller. In addition, the rice-cleaning roller according to the present invention can be formed by a far simpler method than the prior art method. Further, the rice-cleaning roller according to the present invention, which, unlike the prior art one, comprises pluralities of rectangular grinding type roller elements and friction type roller elements arranged alternately side by side in the circumferential direction, a rice-cleaning operation of a long stroke can be obtained and also grinding and frictional smoothing of rice grains can be obtained simultaneously.

I claim:

1. A grinding type rice cleaning roller, comprising:

a vertical shaft having four equally spaced planar mounting sections disposed about its periphery, and grooves formed between adjacent mounting sections;

roller elements each having a planar inner surface adapted to engage in close contact each said planar mounting section, with the sides of each roller element flaring toward said inner surface; and roller element retainers each having retainer edges which bear against and hold the sides of adjacent roller elements, respectively, each retainer being configured for secure fit within each said groove.

2. A grinding type rice cleaning roller, comprising:

an elongate cylindrical mounting element having a plurality of planar surfaces extending along the exterior, and in the direction of the longitudinal axis, of said mounting element, and further having a plurality of grooves, each groove having a bottom surface extending in said direction and being disposed between, and having its width delimited by, sides of adjacent ones of said planar surfaces;

a grinding-type roller element for mounting on each of said mounting element planar surfaces, each said roller element having a planar surface disposed in overlying relationship with a corresponding one of said mounting element planar surfaces; and a plurality of retainer means each having a first surface, a second surface parallel to said first surface, and side surfaces, and each said retainer means being configured to fit snugly in one of said grooves defined by sides of adjacent ones of said mounting element planar surfaces with the second surface of each retainer means facing the bottom surface of said mounting element groove, each one of said roller elements being secured against a planar surface of said mounting element by two adjacent retainer means.

3. The cleaning roller of claim 2, wherein each said roller element further includes a grinding surface, and said side surfaces extend divergently from said grinding surface to said planar surface; and each said retainer means side surface includes a first segment disposed within said mounting element groove and a second segment overlying one side surface of an adjacently disposed roller element, whereby each pair of adjacent retainer means coact to clamp a roller element onto said mounting element planar surface.

4. The cleaning roller of claim 2, wherein two roller elements are mounted, one behind the other in said direction, on each of said mounting element planar surfaces, and each of said retainer means comprises a pair of retainer elements for each roller element, each said roller element being held on a respective planar surface by each two adjacent retainer elements disposed peripherally about said mounting element.

5. The cleaning roller of claim 4, wherein said two roller elements comprise a grinding type element and a friction type element, and the arrangement of roller elements disposed on one mounting element planar surfaces is reversed on the adjacent mounting element planar surface.

6. The cleaning roller of claim 4, and further including means, located within said mounting element, for supplying a pressurized fluid to the grinding surfaces of said roller elements, and means for communicating the interior of said mounting element with said roller element grinding surfaces including fluid conduits extending through said mounting element and selected ones of said retainer means.

7. The cleaning roller of claim 2, and further including means, located within said mounting element, for supplying a pressurized fluid to the grinding surfaces of said roller elements, and means for communicating the interior of said mounting element with said roller element grinding surfaces including fluid conduits extending through said mounting element and selected ones of said retainer means.

* * * * *